United States Patent [19]

Makishi

[11] Patent Number: 4,982,953

[45] Date of Patent: Jan. 8, 1991

[54] EXERCISE APPARATUS

[76] Inventor: Todd K. Makishi, 16405 S. Gramercy Pl., Gardena, Calif. 90247

[21] Appl. No.: 500,533

[22] Filed: Mar. 26, 1990

[51] Int. Cl.[5] ..... A63B 69/16

[52] U.S. Cl. ..... 272/73; 272/129; 434/247

[58] Field of Search ..... 272/73, 129, 72, 128, 272/69; 128/25 R; 310/103, 105; 73/862.17; 434/247

[56] References Cited

U.S. PATENT DOCUMENTS

| | | | |
|---|---|---|---|
| 4,565,365 | 1/1986 | Bankhurst . | |
| 4,572,502 | 2/1986 | Messineo . | |
| 4,595,194 | 6/1986 | Previtali . | |
| 4,648,597 | 3/1987 | Adler . | |
| 4,768,782 | 9/1988 | Blackburn . | |
| 4,802,666 | 2/1989 | Rodriqguez | 272/73 |
| 4,826,150 | 5/1989 | Minoura | 272/73 |

*Primary Examiner*—Stephen R. Crow
*Attorney, Agent, or Firm*—Leon Gilden

[57] ABSTRACT

An apparatus is set forth including a forward and rearward support roller orthogonally and rotatably mounted upon spaced rails. The rear support roller includes a rear belt member rotatably mounted therewith and cooperative with a forward pulley. The forward pulley is fixedly mounted to a cylindrical support shaft rotatably mounted within an adapted block mounted between the forward and rear support roller upon the right frame rail. The support shaft includes a mounted bi-polar magnetic cylinder to effect resistance during rotation of the cylinder relative to the right frame rail. The cylinder includes a further cylinder adapter securable thereto to enhance magnetic attraction between the frame rail and the cylinder and further cylinder. Alternatively, a weight member may be mounted to a forward portion of the support shaft. The magnetic cylinder is also selectively mounted on a threaded shaft to space the cylinder relative to the right frame rail to vary magnetic resistance therebetween and associated resistance when an associated bicycle is mounted on the forward and rear support roller.

5 Claims, 4 Drawing Sheets

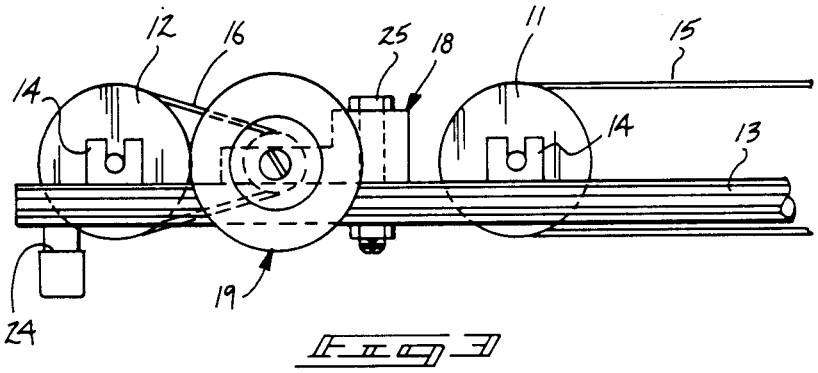
FIG 3
FIG 4
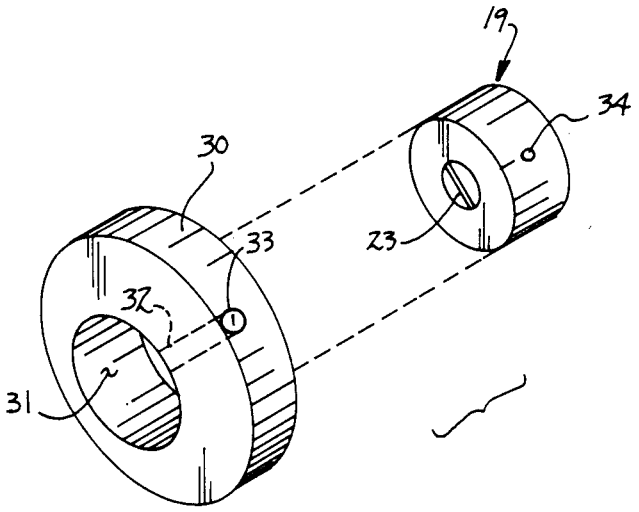

EXERCISE APPARATUS

BACKGROUND OF THE INVENTION

1. Field of the Invention

The field of invention relates to exercise apparatus, and more particularly pertains to a new and improved exercise apparatus wherein the same mounts a bicycle thereon and includes variable resistance means to vary resistance in use of the bicycle on the apparatus.

2. Description of the Prior Art

Various exercise apparatus have been utilized in the prior art to adapt and accommodate conventional bicycles onto a support structure. The support structure has utilized spaced rollers to position the rear drive wheel of the associated bicycle in a manner to effect exercise in its use while enabling utilization of the bicycle within a limited space or interior environment. Examples of the prior art include U.S. Pat. No. 4,565,365 wherein spaced rollers are mounted within a framework organization to secure a bicycle thereto in a manner consistent with the prior art.

U.S. Pat. No. 4,768,782 to Blackburn provides a further example of a prior art exercise device wherein a support framework secures an associated axle of a bicycle relative thereto to enable engagement of the tire of the bicycle with a resistance roller.

U.S. Pat. No. 4,648,597 to Adler provides a bicycle support device utilizing a vertical frame member mounting a single roller thereto with a "U" shaped support mounting the bicycle to the frame member.

U.S. Pat. No. 4,572,502 to Messineo utilizes a "U" shaped bracket member to support the spaced frame rails of an associated bicycle thereto to enable the bicycle to be maintained in a spaced relationship relative to a floor for support thereof.

U.S. Pat. No. 4,595,194 to Previtali provides a bicycle training apparatus wherein the same provides a support framework for securing the bicycle in engagement with resistance rollers as another example of a typical prior art exercise device.

As such, it may be appreciated that there is a continuing need for a new and improved exercise apparatus which addresses the problems of readily accommodating a variable resistance device to an exercise apparatus supporting a bicycle thereon and in this respect, the instant invention substantially fulfills this need.

SUMMARY OF THE INVENTION

In view of the foregoing disadvantages inherent in the known types of exercise apparatus now present in the prior art, the present invention provides an exercise apparatus wherein the same utilizes an adapter block to mount a resistance member adjacent the framework of an associated exercise apparatus. As such, the general purpose of the present invention, which will be described subsequently in greater detail, is to provide a new and improved exercise apparatus which has all the advantages of the prior art exercise apparatus and none of the disadvantages.

To attain this, the present invention sets forth an apparatus including a forward and rearward support roll orthogonally and rotatably mounted upon spaced rails. The rear support roll includes a rear belt member rotatably mounted therewith and cooperative with a forward pulley. The forward pulley is fixedly mounted to a cylindrical support shaft rotatably mounted within an adapter block mounted between the forward and rear support rolls upon the right frame rail. The support shaft includes a mounted bi-polar magnetic cylinder to effect resistance during rotation of the cylinder relative to the right frame rail. The cylinder includes a further cylinder adapter securable thereto to enhance magnetic attraction between the frame rail and the cylinder and further cylinder. Alternatively, a weight member may be mounted to a forward portion of the support shaft. The magnetic cylinder is also selectively mounted on a threaded shaft to space the cylinder relative to the right frame rail to vary magnetic resistance therebetween and associated resistance when an associated bicycle is mounted on the forward and rear support rolls.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved exercise apparatus which has all the advantages of the prior art exercise apparatus and none of the disadvantages.

It is another object of the present invention to provide a new and improved exercise apparatus which may be easily and efficiently manufactured and marketed.

It is a further object of the present invention to provide a new and improved exercise apparatus which is of a durable and reliable construction.

An even further object of the present invention is to provide a new and improved exercise apparatus which is susceptible of a low cost of manufacture with regard to both materials and labor, and which accordingly is then susceptible of low prices of sale to the consuming public, thereby making such exercise apparatus economically available to the buying public.

Still yet another object of the present invention is to provide a new and improved exercise apparatus which provides in the apparatuses and methods of the prior art some of the advantages thereof, while simultaneously overcoming some of the disadvantages normally associated therewith.

Still another object of the present invention is to provide a new and improved exercise apparatus wherein the same accommodates a variable resistance member in association with an exercise framework securing a bicycle thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side orthographic view taken in elevation of the exercise apparatus of FIG. 2.

FIG. 4 is an exploded isometric illustration of the resistance roller organization of the instant invention.

FIG. 7 is an exploded isometric illustration of the adapter block and its association with a resistance member utilized by the instant invention.

DESCRIPTION OF THE PREFERRED EMBODIMENT

Figure 1:
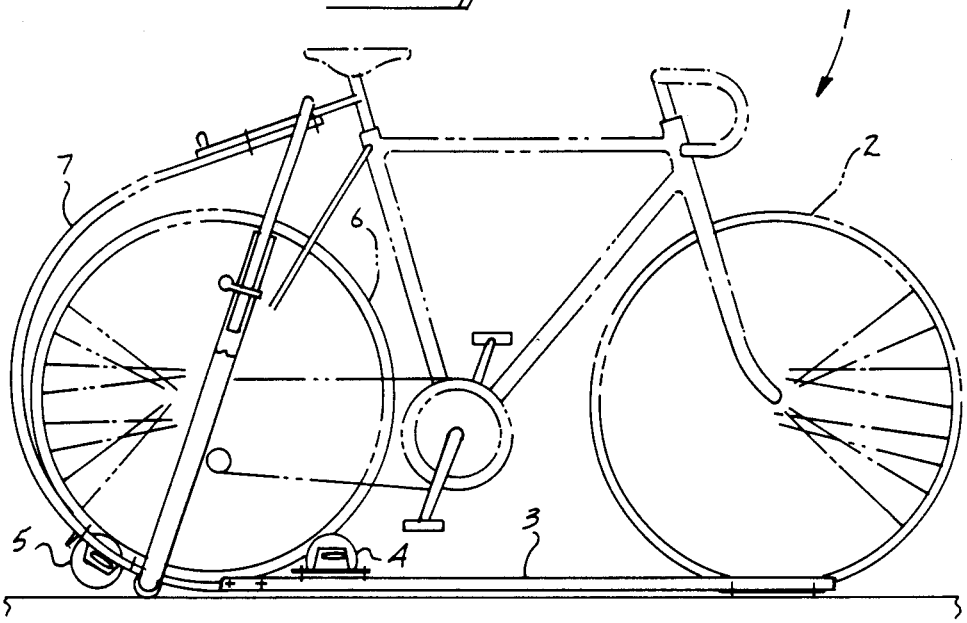
FIG. 1 is an orthographic view taken in elevation of a prior art exercise apparatus in association with a conventional bicycle.
Figure 2:
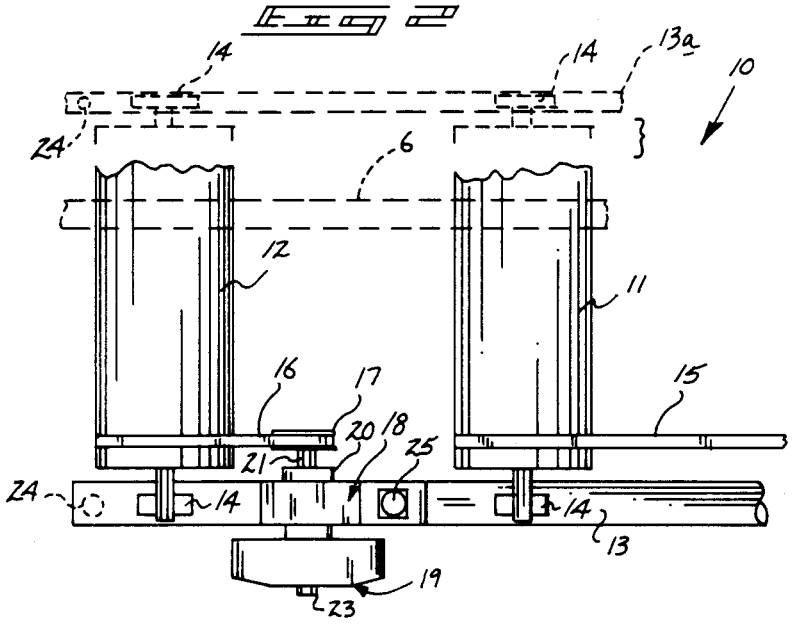
PRIOR ART FIG 2
FIG. 2 is a top orthographic fragmented view illustrating the instant invention in association with spaced frame rails and resistance rollers of an exercise apparatus.

With reference now to the drawings, and in particular to FIGS. 1 to 7 thereof, a new and improved exercise apparatus embodying the principles and concepts of the present invention and generally designated by the reference numeral 10 will be described.

FIG. 1 is an example of a typical prior art exercise apparatus 1 provided with a bicycle 2 formed with a forward wheel and a rear wheel 6. The rear wheel 6 is rotatably mounted in operative association with a forward roller 4 and a rear roller 5 that are in turn secured to a framework 3. The bicycle is secured to the framework 3 by an associated bracket member 7 to enable rolling resistance of a bicycle in association with the aforenoted rollers.

More specifically, the exercise apparatus 10 of the instant invention essentially comprises a forward support roller 11 spaced parallel to and forwardly of a rear support roller 12. The support rolls 11 and 12 are rotatably mounted between parallel right and left frame rails 13 and **13*a*, as illustrated in FIG. 1. The support rollers also include outwardly coaxially extending axles that are rotatably mounted within spaced pairs of axle support bearings 14 to maintain the rollers 11 and 12 in a parallel relationship. The forward support roller 11 includes a forward belt 15** that is mounted in an operative association with various accessories, such as a speedometer, light generator, and the like (not shown), typically utilized with such exercise apparatus. The forward roller is operated associated with a third support roller (not shown) which provides support and rotational balancing for the front wheel of the bicycle when in use.

The rear roller 12 utilizes a rear belt 16 mounted orthogonally relative to the axis of the rear roller 12 in operative association with a rotatable pulley member 17. An "L" shaped adapter block 18 is mounted between the forward and rear support rollers 11 and 12 and is mounted onto a top surface of the right frame rail 13. Furthermore, the adapter block 18 is defined by a width substantially equal to the width of the rail 13, and wherein the adapter block 18 is formed with parallel forward and rear surfaces defined by a rear surface **18*a* and a forward surface 18*b* generally aligned with the side surfaces of the associated frame rail 13** and aligned therewith.

A cylindrical support shaft 20 is rotatably received within the "L" shaped adapter block 18 and includes a rear reduced shank support 21 and a forward reduced shank support 22 extending coaxially of the support shaft 20 and extending orthogonally relative to the rear and forward faces **18*a* and 18*b* respectively of the adapter block 18. A first bi-polar annular magnetic cylinder 19 is positioned in proximity to the right frame rail 13 to create resistance during rotation of the magnetic cylinder 19 relative to the forward side surface of the right frame rail 13. A securement bolt 23 is threadedly received within a threaded bore of the forward shank support 22. It is noted in FIG. 3 for example that a series of support legs 24 mounted with friction cups thereon at their lowermost ends support the frame rails 13** in a spaced relationship above an associated support surface, such as a floor.

An adapter bolt 25 secures the adapter block 18 to the right frame rail 13 and is received through a first bore 26. The first bore 26 is formed within an upstanding boss of the right frame rail 13, wherein the boss is of a generally square or rectangular parallelepiped configuration to be received within the boss bore **26*a*, as illustrated in FIG. 7 for example. The bolt 25 fixedly secures in a vibration-free manner the adapter block 18** in use.

The adapter block 18, as illustrated in FIG. 7, is formed with a horizontal leg 28 and a vertical leg 29 extending orthogonally upwardly therefrom, wherein the vertical leg 29 receives the boss and the bolt member 25 therethrough. The horizontal leg 28 is formed with a second cylinder bore 27 directed orthogonally through the horizontal leg 28 and is of a diameter substantially equal to the diameter defined by the cylindrical support shaft 20. As the rear reduced shank support 21 extends orthogonally rearwardly of the rear face **18*b* and the forward reduced shank support 22 and extends orthogonally and forwardly of the forward planar side 18*a*, the annular magnetic cylinder 19 is maintained in a parallel relationship relative to the rail 13** in use.

FIG. 4 is illustrative of a magnetic adapter cylinder 30 of a bi-polar configuration. The adapter cylinder 30 is formed with a through-extending adapter cylinder bore 31 equal to the diameter of the magnetic cylinder 19 to receive the cylinder 19 in a complementary manner therewithin. A threaded bore 32 is radially directed through the adapter cylinder 31 and receives a threaded fastener 33 therethrough that is directed into the adapter bore 31 to be received within a recess 34 formed within the annular surface of the magnetic cylinder 19 to align the cylinder 19 and the adapter cylinder 31 together to increase resistance of the magnetic cylinder 19 in use and thereby enable modification of the resistance to a user of the device.

Figure 5:
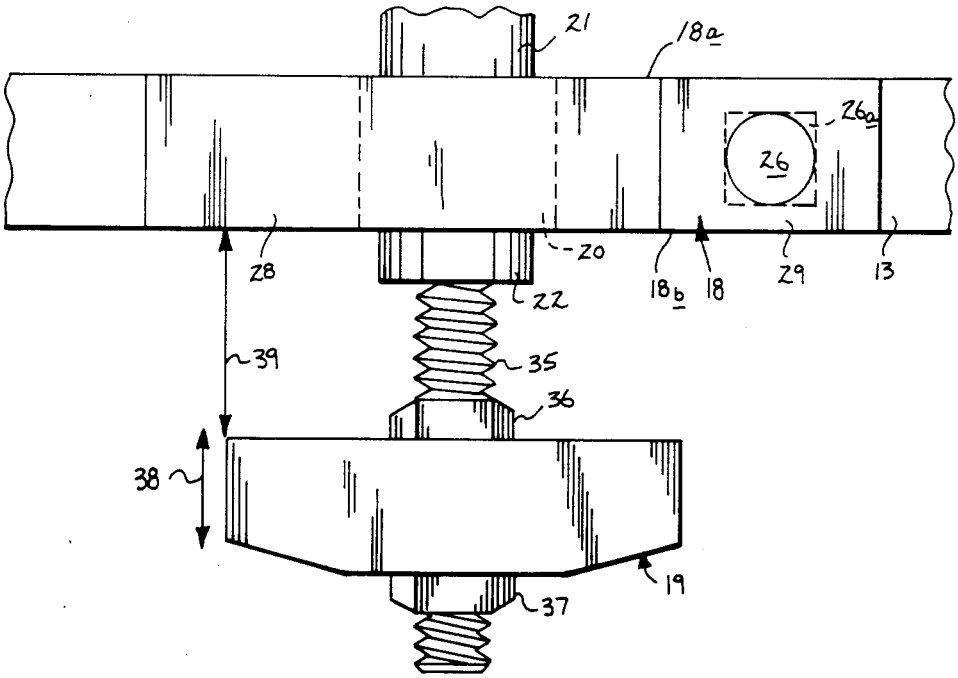
FIG. 5 is a top orthographic view illustrating a modification of the resistance member in association with the right frame rail in an adjustable manner.
Figure 6:
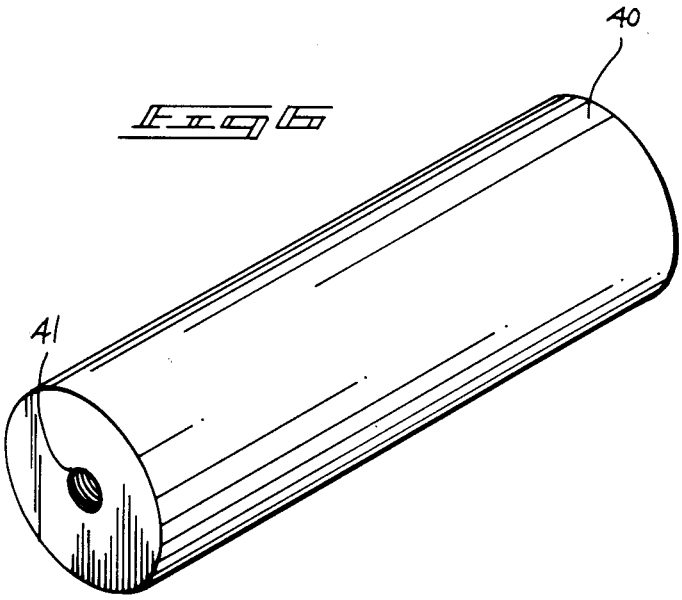
FIG. 6 is a isometric illustration of a weighted roller securable to the organization of the instant invention.
Figure 11:
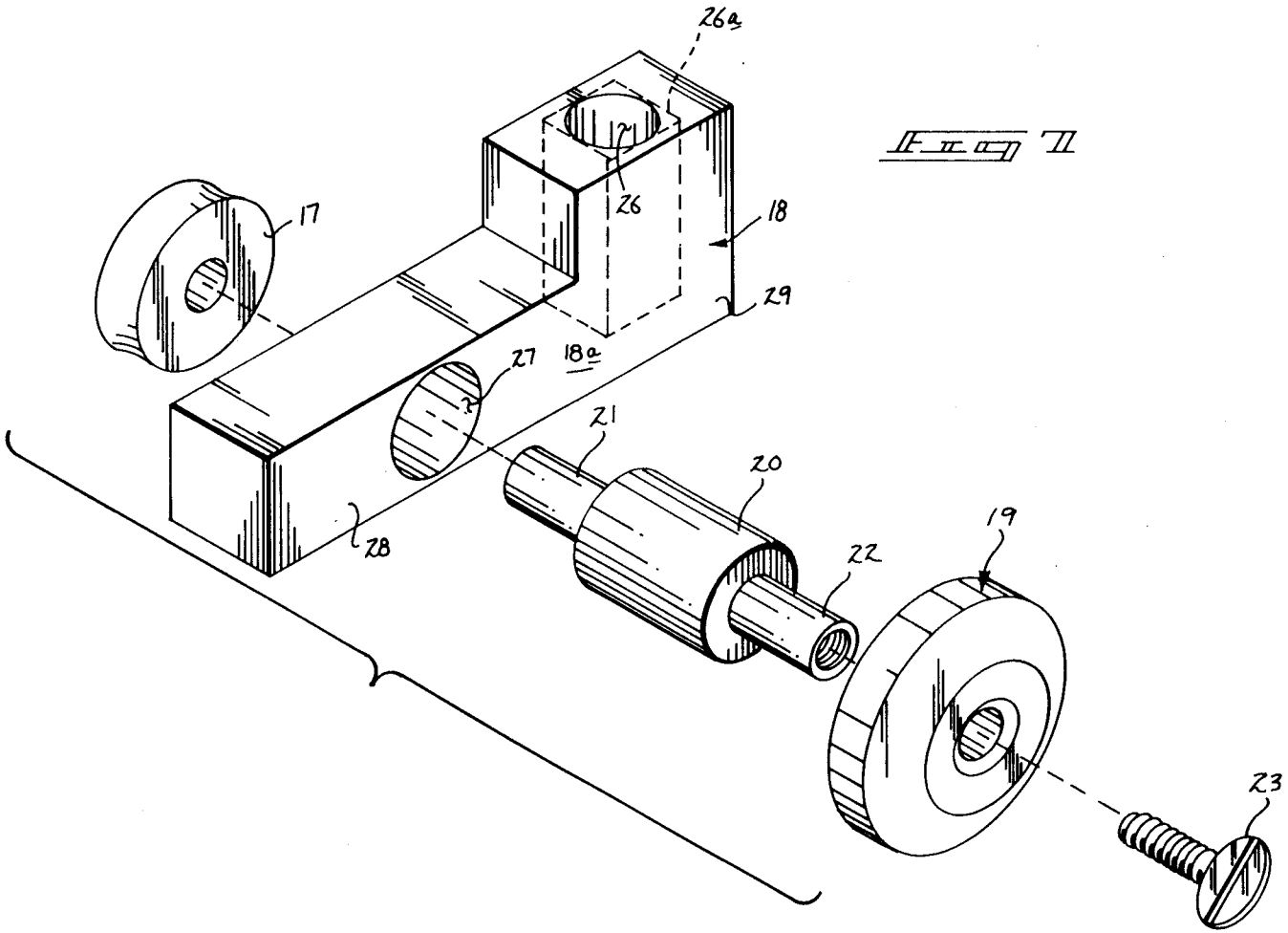

FIG. 5 is illustrative of the use of a threaded support shank 35 to mount the magnetic cylinder 19 thereon in an adjustable manner utilizing a first and second threaded fastener 36 receiving the threaded support shank 35 therethrough to adjust the magnetic cylinder 19 and an associated defined spaced distance 39 in the direction of the arrow 38. Varying of a distance of the magnetic cylinder 19 relative to the rail 13 further enables diminishing of the magnetic effect and resistance performed by the magnetic cylinder 19.

Alternatively, a weighted adapter cylinder 40 formed with a threaded adapter bore 41 may be mounted to the threaded support shank 35 wherein it is contemplated a variety of weighted cylinders 40 may be utilized to provide weighted resistance in use of the apparatus.

As to the manner of usage and operative of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An exercise apparatus for support of a bicycle thereon comprising, in combination, a framework including a right and a left spaced parallel rail arranged in alignment relative to one another including a forward support roller and a rear support roller for support of a rear wheel of the bicycle thereon, the forward and rear support rollers orthogonally and rotatably mounted to the right and left rails, and an adapter member including a forward and rear planar surface mounted on one of said rails, the forward and rear planar surfaces arranged in longitudinal alignment with side surfaces of the one of said rails, wherein the adapter member is mounted between said forward and rear rollers, and a support shaft rotatably mounted within said adapter member and further including a pulley mounted to the support shaft adjacent the rear planar surface of the adapter member, and a magnetic resistance means mounted to the adapter shaft adjacent the forward planar surface of the adapter member for providing resistance to rotation of the support shaft within the adapter member during rotation thereof said resistance is adjusted by rotation of said resistance means on said shaft.

2. An apparatus as set forth in claim 1 wherein the adapter member is of a generally "L" shaped configuration and includes a horizontal leg mounted to a top surface of the one of said rails and a vertical leg positioned orthogonally and directed upwardly of the horizontal leg, with a first bore directed through the vertical leg for receipt of a fastener member to secure the adapter member to the one of said rails, and a second bore directed orthogonally through the horizontal leg and directed through the rear and forward planar surfaces to rotatably receive the support shaft therethrough.

3. An apparatus as set forth in claim 2 wherein the resistance means is of a generally annular configuration and is formed with a central bore therethrough for securement to the support shaft, and a further cylindrical member including a further cylindrical bore directed axially through the further cylindrical member, and wherein the further cylindrical bore is defined by a diameter substantially equal to the predetermined diameter defined by the resistance means, and a threaded radial bore directed through the further cylindrical member, and a threaded member threadedly received within the threaded bore, and a recess formed within an annular surface of the resistance means to receive a forward terminal end of the threaded member to secure the resistance means and the cylindrical adapter member together in a fixed predetermined orientation relative to one another.

4. An apparatus as set forth in claim 3 wherein the support shaft includes a threaded bore, and a threaded shank directed in the threaded bore, and the resistance means mounted on the threaded shank and including a forward and rear securement member to adjustably secure the resistance means axially along the threaded shank.

5. An apparatus as set forth in claim 4 further including a cylindrical weighted member receivable on a forward end of the threaded shank.

* * * * *